US007943213B2

(12) United States Patent
Weber

(10) Patent No.: US 7,943,213 B2
(45) Date of Patent: May 17, 2011

(54) ARTIFICIAL SURFACE

(76) Inventor: Edward A. Weber, Antioch, IL (US); Jane L. Weber, legal representative, Antioch, IL (US)

( * ) Notice: Subject to any disclaimer, the term of this patent is extended or adjusted under 35 U.S.C. 154(b) by 324 days.

(21) Appl. No.: 12/166,427

(22) Filed: Jul. 2, 2008

(65) Prior Publication Data

US 2009/0011845 A1 Jan. 8, 2009

Related U.S. Application Data

(60) Provisional application No. 60/958,359, filed on Jul. 5, 2007.

(51) Int. Cl.

| | |
|---|---|
| ***E01C 13/08*** | (2006.01) |
| ***B32B 3/12*** | (2006.01) |
| ***B32B 3/18*** | (2006.01) |
| ***A63C 19/04*** | (2006.01) |

(52) U.S. Cl. ..... 428/17; 428/86; 428/95; 428/68; 428/71; 428/72; 428/73; 428/76; 472/92

(58) Field of Classification Search ..... 428/17, 428/95, 86, 68, 71, 72, 73, 76
See application file for complete search history.

(56) References Cited

U.S. PATENT DOCUMENTS

| | | | | |
|---|---|---|---|---|
| 2,613,398 | A | | 10/1952 | Crowell |
| 3,323,802 | A | | 6/1967 | Riner |
| 3,534,961 | A | * | 10/1970 | Tiley ..... 273/108.21 |
| 3,690,673 | A | | 9/1972 | Occhipinti |
| 3,885,795 | A | | 5/1975 | Brewer |
| 3,892,412 | A | | 7/1975 | Koo |
| 3,984,595 | A | | 10/1976 | Stephens |
| 4,060,953 | A | | 12/1977 | Milne |
| 4,327,046 | A | | 4/1982 | Davis et al. |
| 4,347,213 | A | | 8/1982 | Rogers |
| 4,654,268 | A | | 3/1987 | DeBoel et al. |
| 4,761,257 | A | | 8/1988 | Bunn |
| 4,904,430 | A | | 2/1990 | Yamada |
| 5,023,128 | A | | 6/1991 | Fatool |
| 5,037,445 | A | | 8/1991 | Sander et al. |
| 5,079,786 | A | | 1/1992 | Rojas |
| 5,390,926 | A | | 2/1995 | Hanson et al. |
| 5,507,845 | A | | 4/1996 | Molnar et al. |
| 5,618,131 | A | * | 4/1997 | Weber ..... 404/32 |
| 6,156,838 | A | | 12/2000 | Yoshikawa et al. |
| 6,491,991 | B2 | | 12/2002 | Seaton |
| 6,522,131 | B1 | | 2/2003 | Hilligsmann et al. |
| 6,582,819 | B2 | | 6/2003 | McDaniel et al. |

(Continued)

FOREIGN PATENT DOCUMENTS

JP 2002294620 A * 10/2002

*Primary Examiner* — Cheryl Juska
(74) *Attorney, Agent, or Firm* — Lesavich High-Tech Law Group, P.C.; Stephen Lesavitch

(57) ABSTRACT

A layered, artificial surface including plural components filled with microbeads of pre-selected sizes, shapes and depths. The microbeads of the pre-selected sizes and shapes and depths provide plural different types of resistance and firmness for the artificial surface. Pre-determined chemical compounds are applied to the microbeads to change a surface charge on the microbeads, or produced with a desired surface charge to provide different interactions and thus different types of resistance and firmness for the artificial surface. The artificial surface does not require the application of a vacuum to maintain a shape or resistance.

18 Claims, 6 Drawing Sheets

U.S. PATENT DOCUMENTS

| | | | | |
|---|---|---|---|---|
| 6,632,527 | B1 | 10/2003 | McDaniel et al. | |
| 6,683,126 | B2 | 1/2004 | Keller et al. | |
| 7,160,953 | B2 | 1/2007 | Bowers et al. | |
| 7,244,477 | B2 * | 7/2007 | Sawyer et al. | 428/17 |
| 7,585,555 | B2 * | 9/2009 | Stroppiana | 428/95 |
| 7,645,501 | B2 * | 1/2010 | Sawyer et al. | 428/95 |
| 2001/0033902 | A1 | 10/2001 | Seaton | |
| 2002/0048676 | A1 | 4/2002 | McDaniel | |
| 2002/0129561 | A1 | 9/2002 | Silberman | |
| 2003/0044607 | A1 | 3/2003 | Yuuki et al. | |
| 2003/0226501 | A1 | 12/2003 | Anderson | |
| 2004/0127304 | A1 | 7/2004 | Plank | |
| 2004/0151870 | A1 | 8/2004 | Theiss | |
| 2005/0012023 | A1 | 1/2005 | Vock | |
| 2005/0131092 | A1 | 6/2005 | Kurth | |
| 2005/0131093 | A1 | 6/2005 | Kurth | |
| 2006/0037548 | A1 | 2/2006 | Mohr | |
| 2006/0189852 | A1 | 8/2006 | Greenwald | |
| 2006/0211819 | A1 | 9/2006 | Hoenig et al. | |
| 2006/0242901 | A1 | 11/2006 | Casimaty et al. | |
| 2006/0269703 | A1 * | 11/2006 | Stroppiana | 428/34.1 |
| 2007/0066491 | A1 | 3/2007 | Bicerano | |
| 2007/0112127 | A1 | 5/2007 | Soediono et al. | |
| 2007/0148398 | A1 * | 6/2007 | Stroppiana | 428/95 |
| 2007/0209133 | A1 | 9/2007 | Linzell | |
| 2008/0176009 | A1 | 7/2008 | Chereau et al. | |
| 2008/0181969 | A1 | 7/2008 | Blanton et al. | |
| 2008/0182040 | A1 | 7/2008 | Chereau et al. | |
| 2008/0317978 | A1 * | 12/2008 | Smit et al. | 428/17 |
| 2009/0011873 | A1 * | 1/2009 | Weber et al. | 473/497 |
| 2009/0166469 | A1 * | 7/2009 | Prevost et al. | 244/110 R |

* cited by examiner

ARTIFICIAL SURFACE

CROSS REFERENCES TO RELATED APPLICATIONS

This Application claims priority to U.S. Provisional Application, 60/958,359, filed Jul. 5, 2007, the contents of which are incorporated by reference.

FIELD OF INVENTION

This invention relates artificial surfaces. More specifically it relates to an artificial surface suitable for contact by a human foot, and more particularly to an artificial surface suitable for contact by a human foot or other body part, the surface having durability and flexibility in order to provide comfort or reduce injury.

BACKGROUND OF THE INVENTION

An artificial surface suitable for contact by a human foot or other body part tends to lack the flexibility of a natural turf or other desired surface. Any activity or occupation, which requires long periods of standing or moving on foot, is enhanced by a reasonable flexibility of the surface. This reasonable flexibility can add to a person's reasonable endurance and minimize injury.

An artificial surface usually lacks the flexibility of a grass covered surface. This lack of flexibility can cause injury even if the contact with the surface is merely walking or standing.

Artificial surfaces, commonly known as artificial turf, are routinely used for playing surfaces on baseball field, a football field, or another playing surface. One difficulty in this artificial turf occurs because of the surface on which the turf must be mounted. This surface lacks the resiliency of grass and can many times cause injury to the players.

Typical injuries caused by an artificial surface occur to a knee or to a toe. There is even a vernacularly named disease call "turf toe", which refers to a big toe injury caused by artificial turf. What is desired is the provision of a surface with the required durability, while adding thereto the necessary flexibility for the surface in order to avoid the damage caused to knees or toes, or to an athlete in general.

Compensating for the lack of water by an artificial turf surface is difficult. Each artificial surface is different. Differences include variances in the length and the terrain.

While an artificial surface does not soak, or absorb water, as a grass surface does, it is sometimes difficult to remove the water from the surface. Pushing the water off of the surface is time consuming and difficult. Clearly, a simpler method of removing water from the surface is desired.

There have been attempts to solve some of the problems associated with artificial surfaces. For example, U.S. Pat. No. 5,618,131 entitled "Modified artificial surface and method and apparatus of making the same," that issued to Weber teaches "an artificial surface having at least one compartment with a filler therein has the filler held in position by a vacuum." However, these attempts do not solve all of the problems associated with artificial surfaces.

This it is desirable to provide an artificial surface that solved some of the problems described above.

SUMMARY OF THE INVENTION

In accordance with preferred embodiments of the invention, some of the problems associated with artificial surfaces callers are overcome.

A layered, artificial surface including plural components filled with microbeads of pre-selected sizes, shapes and depths. The microbeads of the pre-selected sizes and shapes and depths provide plural different types of resistance and firmness for the artificial surface. Pre-determined chemical compounds are applied to the microbeads to change a surface charge on the microbeads or produced with a desired surface charge to provide different interactions and thus different types of resistance and firmness for the artificial surface. The artificial surface does not require the application of a vacuum to maintain a shape or resistance.

The foregoing and other features and advantages of preferred embodiments of the present invention will be more readily apparent from the following detailed description. The detailed description proceeds with references to the accompanying drawings.

BRIEF DESCRIPTION OF THE DRAWINGS

Preferred embodiments of the present invention are described with reference to the following drawings, wherein.

DETAILED DESCRIPTION OF PREFERRED EMBODIMENTS

Figure 1:
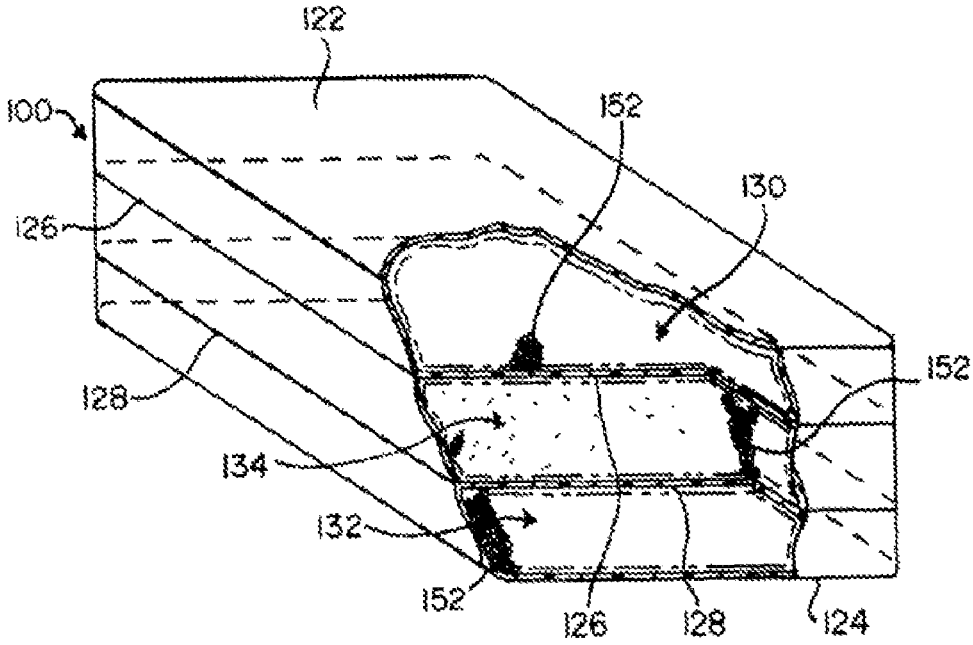
FIG. 1 is block diagram illustrating a perspective partially cutaway view of a plural, compartment-containing device having filler therein.

A FIG. 1 is block diagram illustrating a perspective partially cutaway view of a plural, compartment-containing device having filler therein. A device having at least one compartment containing a filler can have the filler placed in a fixed position by the application of a vacuum to the filler-containing compartment. The vacuum supports the filler in a position, while providing flexibility and durability for the outer surface of the compartment.

The contour of the surface of this device can be changed by positioning the filler inside the compartment. Then by application of the vacuum to the compartment, the filler becomes secured in a position to maintain the contour of the surface.

The surface can then conform to a desired use for the device. This device can then retain a given surface or have that surface changed when desired.

Very desirably, an advantageous use for this device is an artificial turf having a changeable surface. The artificial turf is secured to a bottom sheet at the edges thereof to form the compartment. An opening to the compartment is achieved by a valve suitable for having a vacuum applied thereto.

Into the compartment is placed a filler. After the vacuum is applied to valve, the filler provides the outer surface with a firm but flexible surface. This feature serves to reduce fatigue.

The contour of the surface of this turf can be changed at will to conform to a desired use. This turf can then retain a given surface or be changed when desired.

Plural small compartments can be assembled and placed in a frame. The surface may then be covered as surface. Such a structure, like any structure disclosed herein can be used in the place of employment, any recreational area or other area as desired.

This artificial turf can be used for an in-home putting green for golf. It can also be used for miniature golf and indoor golf. Because of its changeable contour, this turf may also be used to replace artificial turf on football, baseball and soccer fields along with tennis courts, and other athletic fields. It can even be used on golf courses where water use is restricted.

This turf is made from two pieces of a sheet material welded together along the edge of the sheet and filled with pellets of plastic beads or a similar particle. It makes a bag-type container, like a giant, flat bean bag. The size can be made to anyone's specifications with a surface area of up one square mile. A larger surface is usually assembled on site.

Smaller filler container compartments can be framed and positioned as desired. These smaller containers can be assembled on site or off site. If off site is desired, the smaller compartments are easily transported.

With the particles in the compartment, usually in the form of a bag or a container, a desired flexibility is achieved. This flexibility greatly reduces the injuries that can and do result from playing on the standard artificial turf.

This structure can also be used as a floor surface in a factory or other place of business, where standing or being on foot is required. This compartmented structure provides comfort for the worker.

In one embodiment, the surface is made firm by applying a vacuum. The pressure can be adjusted from a positive pressure to twenty-nine inches of mercury. The greater the vacuum pressure, the firmer the surface. Therefore, the user of the surface can adjust the firmness of the surface to the required parameters use. When used outside, the vacuum can be reversed to inflate the turf. The turf then assumes a shape which forces the water from a rain to be quickly removed.

The filler may be any suitable particulate filler or bead filler. Preferably, the filler has a diameter of up to about one centimeter. More preferably, the filler has a diameter of about 0.01 to about 0.9 centimeter. Most preferably, the filler has a diameter of about 0.05 to about 0.8 centimeter.

The sheet used herein may be any suitable substantially air impermeable, edge bondable sheet. A rubber sheet is useful. Also a synthetic resin sheet or a plastic sheet is usable.

Considering now FIG. 1, a perspective partially cutaway view of a plural, compartment-containing device 100 having filler 152 therein includes a first outer sheet 122 and a second outer sheet 124. Therebetween is a first interior sheet 126 and a second interior sheet 128. This structure may be used for an athletic surface or a factory floor.

First outer sheet 122 is oppositely disposed from second outer sheet 124, with first interior sheet 126 and a second interior sheet 128 therebetween. All sheets are edge bonded. First outer sheet 122 is adjacent to first interior sheet 126. Second outer sheet 124 is adjacent to second interior sheet 128. First interior sheet 126 is adjacent to second interior sheet 128.

First outer sheet 122 combines with first interior sheet 126 to form first outer pocket 130. Second outer sheet 124 combines with second interior sheet 128 to form second outer pocket 132. First interior sheet 126 combines with second interior sheet 128 to form inner outer pocket 134.

Figure 2:
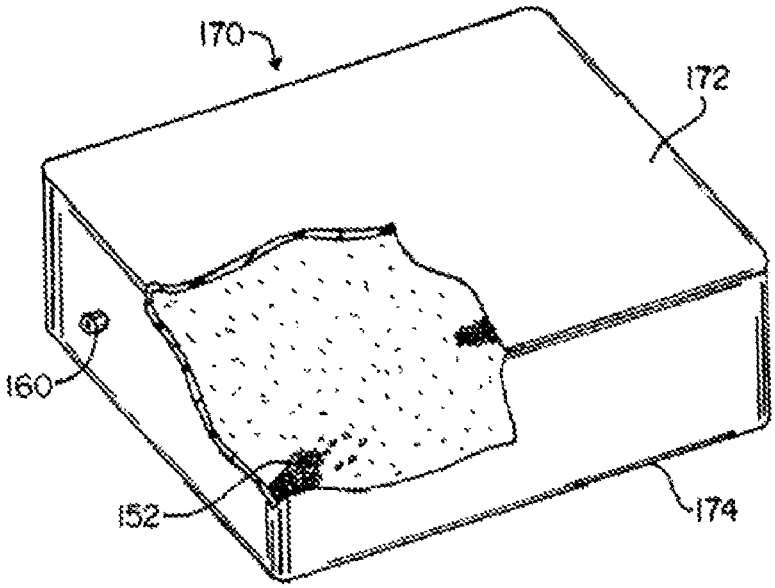
FIG. 2 is block diagram illustrating a perspective partially cutaway view of a single compartment-containing device having filler therein.

With FIG. 2 is block diagram illustrating a perspective partially cutaway view of a single compartment filler-containing device 170 having filler 152 therein. First flexible sheet 172 and second flexible sheet 174 are edge bonded with vacuum valve 160 access for attaching pump 150 thereto. This structure may also be used for an athletic surface or a factory floor.

Figure 3:
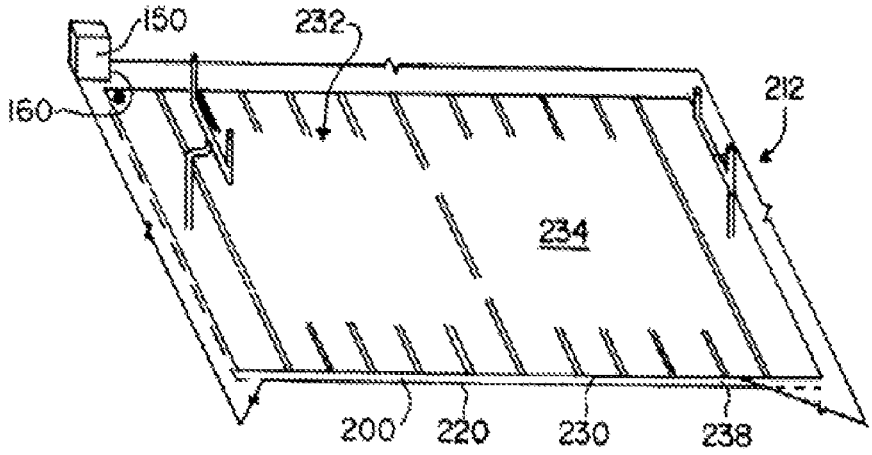
FIG. 3 is block diagram illustrating a perspective, partially cutaway view of an artificial turf surface in the shape of a football field.

Referring now to FIG. 3, the artificial turf surface container 200 is depicted. The turf surface container 200 includes a bottom sheet 220 secured to a top sheet 230. The bottom sheet 220 basically has two plain sides. The securing of the bottom sheet 220 to the top sheet 230 may be achieved in any suitable airtight fashion. A securing mechanism is exemplified by sewing, welding, glue, or other suitable mechanism. The artificial turf surface 200 in the shape of a football field 212.

The turf top sheet 230 and the bottom sheet 220 are sufficiently durable material to stand the pounding that any athletic event, such as, in this particular case, a football field 212, can administer to the turf surface.

The top sheet 230 includes a turf surface 232 and a flat surface 234. Flat surface 234 appears on the interior space 238 of the artificial turf surface container 200. The grasslike or artificial turf surface 232 appears on the top thereof and is marked appropriately for a football field 212.

Within the space 238 created between the two sheets, is inserted a durable flexible material such as glass beads 152. The two sheets 220 and 230 are connected to a vacuum pump 150. Pump 150 can withdraw or insert air in between the sheets 220 and 230 to be contained in space 238. As the air is withdrawn, the glass beads 152 between the sheets provide for flexibility of the sheet.

The vacuum valve 160 permits the pump 150 to communicate with interior 238. Thus, the pump 150 can withdraw air from the space 238.

Figure 4:
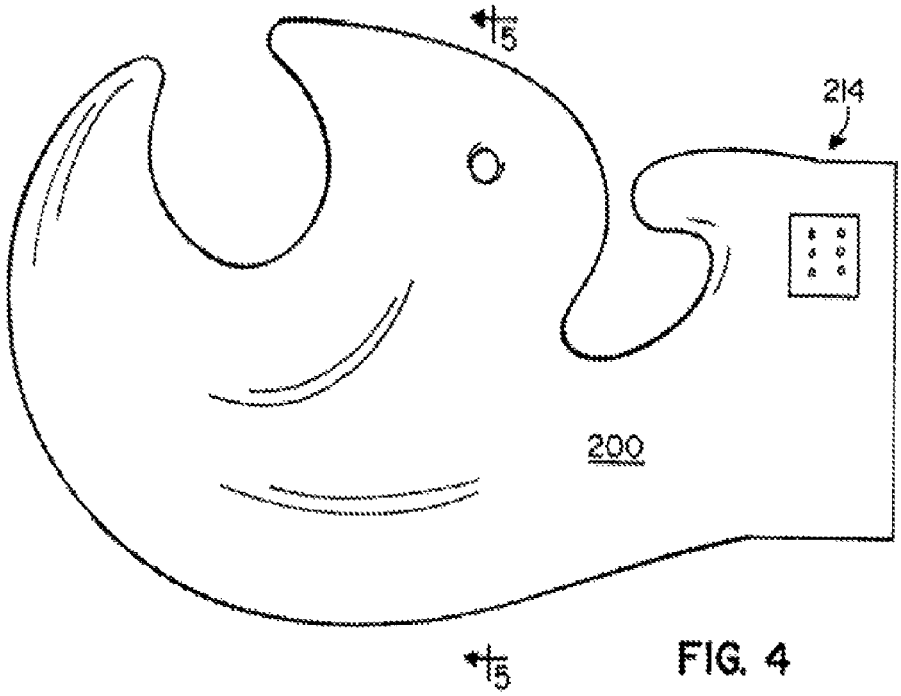
FIG. 4 is block diagram illustrating a top plan view of an artificial turf surface in the shape of a hole for miniature golf.
Figure 5:
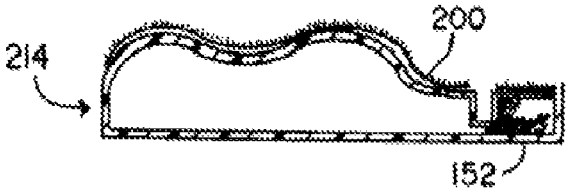
FIG. 5 is block diagram illustrating a side, cross-sectional view of artificial turf surface in the shape of a hole for miniature golf based on FIG. 1.

Referring now to FIG. 4, where the shape of a hole for miniature golf 214 is seen, it is possible to position the glass beads 152 there between the sheets. As the glass beads 152 are positioned, and the vacuum is drawn by pump 150, the glass beads 152 are held into the appropriate position to achieve the desired results of the shape of the hole for miniature golf 214.

Figure 6:
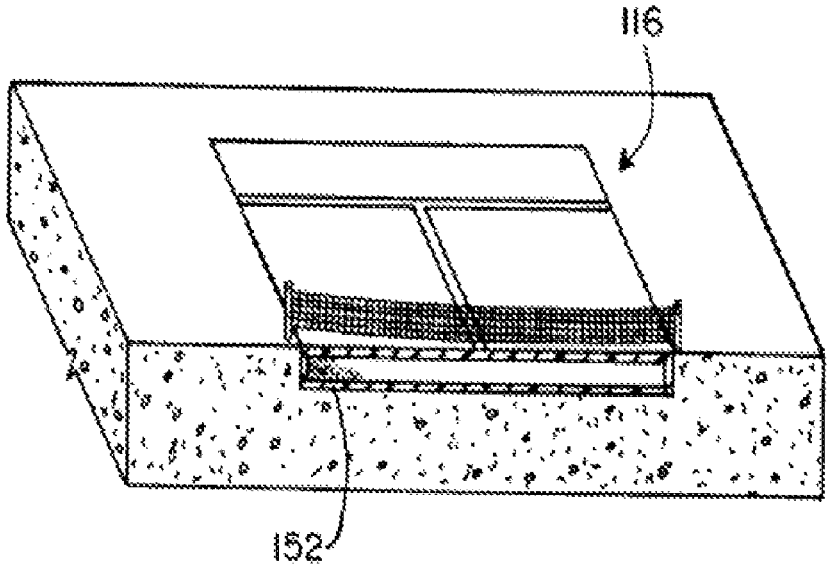
FIG. 6 is block diagram illustrating a perspective partially cutaway view of artificial turf surface in the shape of a tennis court.

Referring now to FIG. 6, the artificial turf surface for shape of a tennis court 216 is similar to that of a football filed 212 but varies in size, shape and markings. The tennis court 216 uses the glass beads 152 to create a flat grasslike surface and provide for the flexibility and durability of artificial turf.

Figure 7:
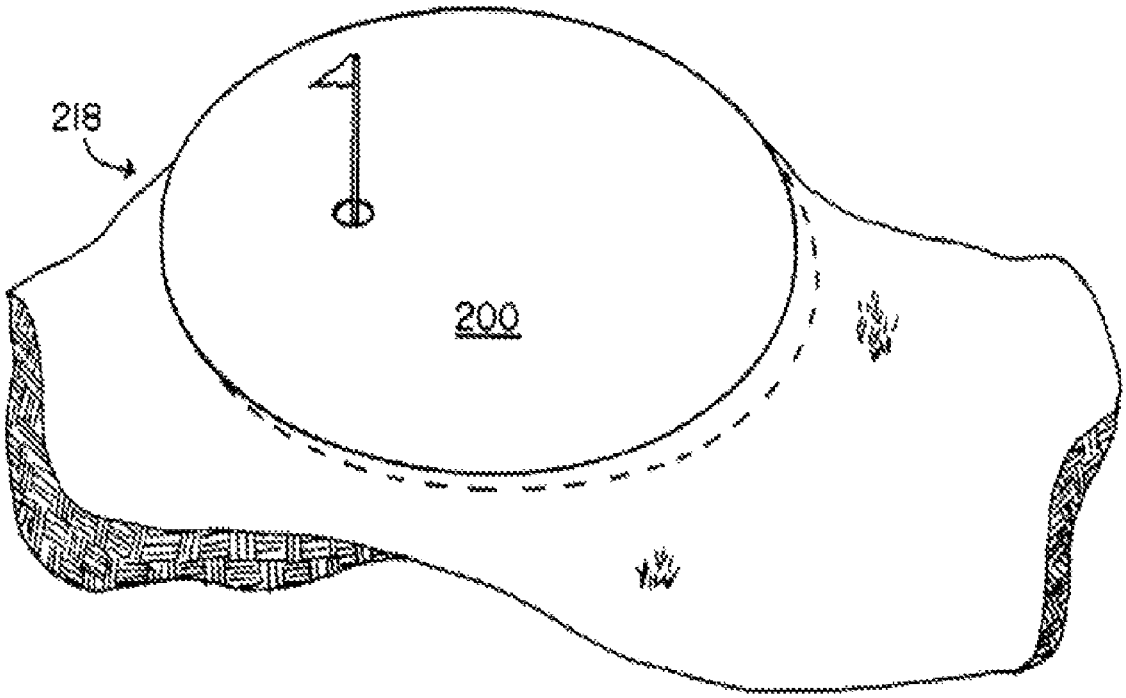
FIG. 7 is block diagram illustrating a perspective partially cutaway view of artificial turf surface in the shape of a hole for standard golf.

In FIG. 7, the artificial turf surface is block diagram illustrating a standard golf course 218 which is basically an enlargement of FIG. 4. This artificial turf surface 200 can be made through a plurality of pockets and joining to achieve the desired result. However, with the vacuum aspect of the beads, it is possible to make two big sheets of sufficient size and shape for the golf course. In this fashion, as the beads are shaped, the vacuum can be drawn and the desired results are obtained.

Figure 8:
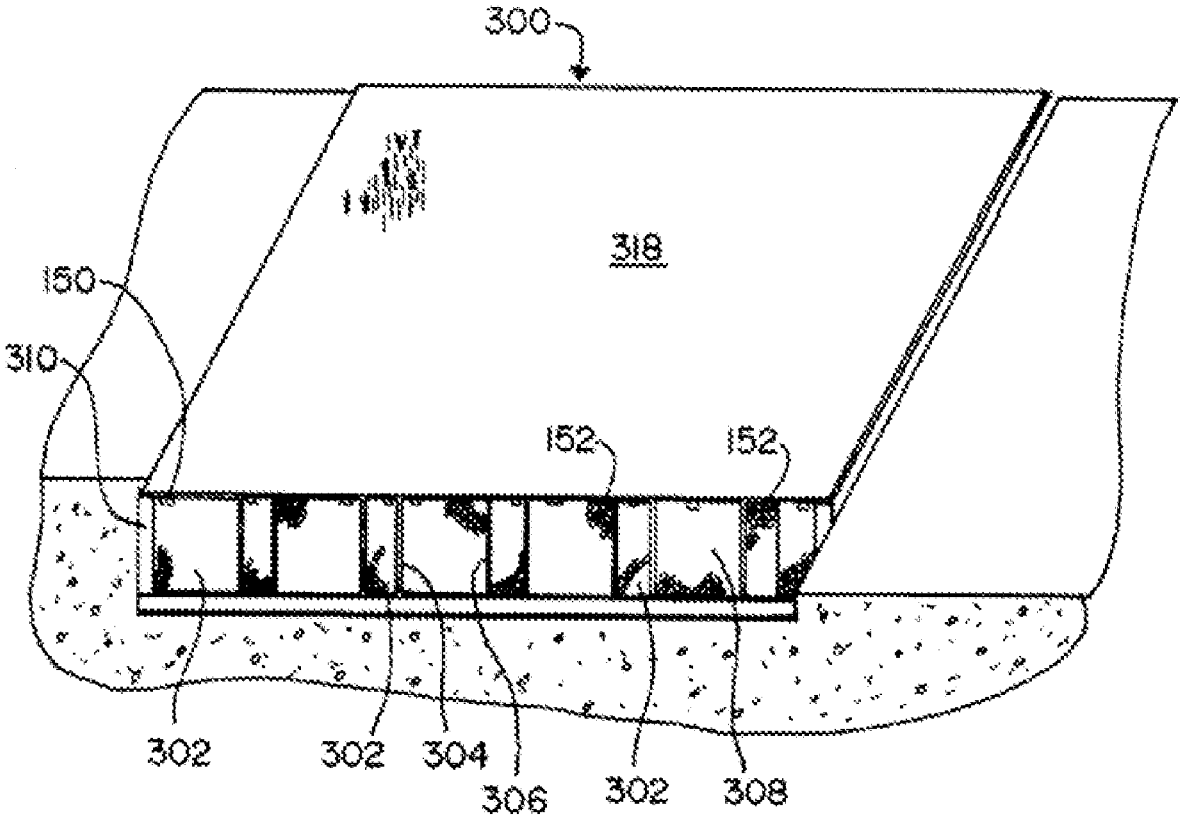
FIG. 8 is block diagram illustrating a perspective partially cutaway view of sheet turf surface supported by a plurality of small filled compartments.

FIG. 8 is block diagram illustrating a perspective partially cutaway view of sheet turf surface 300 supported by a plurality of small filled compartments 302. Each filled compartment 302 has a first small sheet 304 edge secured to a second small sheet 306 with a vacuum valve 150 granting access to small interior 308 for filler 152. A plurality of small compartments 302 are mounted in frame 310, which in turn is covered with turf sheet 300. The vacuum applied to each filled compartment 302 determines the flexibility of the surface 318.

Non-Vacuum Artificial Surface

Figure 9:
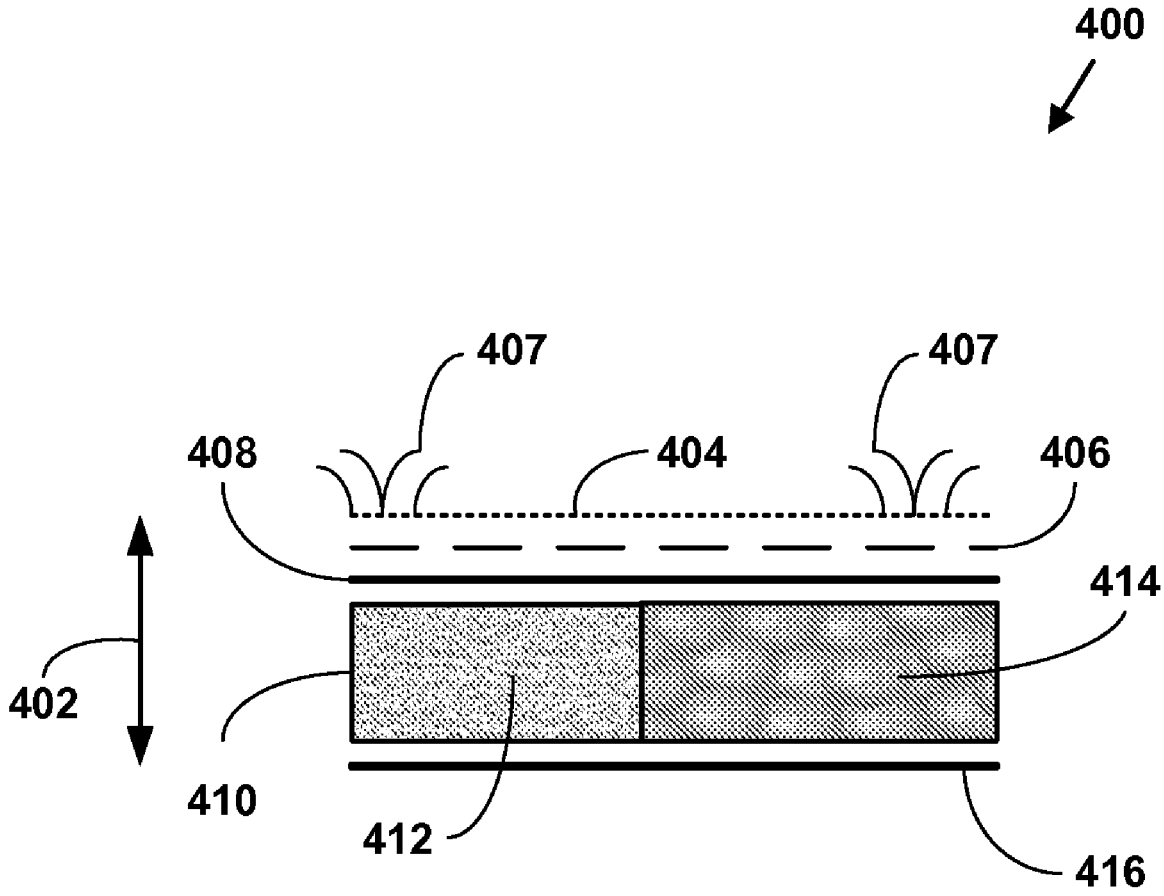
FIG. 9 is a block diagram illustrating a side view of an exemplary artificial surface with plural layers including plural different fillers for the layers.

FIG. 9 is a block diagram illustrating 400 a side view of an exemplary artificial surface 402 with plural layers. In one embodiment, the artificial surface 402 includes a cover layer (e.g., 404, 406, 407, 408. etc.) and a configurable layer (e.g., 410, 412, 414, etc.), each comprising plural components. FIG. 9 illustrates separation between all the layers. However in the actual artificial surface 402, the layers are touching and connected.

The artificial surface 402 does not require the application of a vacuum to maintain a shape or resistance or firmness of the artificial surface 402. An initial contour of the artificial surface is formed by filling the plural separate compartments with microbeads of a pre-selected sizes and shapes to pre-selected depths. A resistance and firmness of the artificial surface is provided by the interactions of surfaces of the microbeads. A contour of the surface is easily changed by changing the pre-selected sizes and shapes and depths of the microbeads and their placement ordering in the plural separate compartments. The different sizes and shapes of microbeads become secured in a position in the plural compartments based on the characteristics and interactions of surfaces of the microbeads to maintain a desired contour and resistance and firmness of the artificial surface.

In one embodiment, the artificial surface 402 includes a top layer comprising an artificial turf sheet 404. In one embodiment, the turf sheet 404 in includes a first permeable layer 406 below the turf sheet 404. In another embodiment, the turf sheet 404 and the first permeable layer 406 are combined and provide a top surface that a user interacts with. In this embodiment, the combined layer 404, 406 absorbs and drains water.

In one embodiment, the first permeable layer 406 is a composite material. In another embodiment, the first permeable layer 406 is a flexible masonry lining used typically used in association with laying brick or others masonry. In another embodiment, the first permeable layer 406 is a specialized polypropylene.

In one embodiment, the turf sheet 404 comprises a specialized polyethylene that includes plural soft polyethylene two inch synthetic fibers 407 that are UV protected that has been tufted on a porous backing and resembles real grass. The plural fibers 407 are water resistant the porous backing insures the proper drainage. Two sets of plural fibers 407 are illustrated in FIG. 9 for simplicity. However, the present invention is not limited to such an embodiment and plural fibers 407 on the turf sheet 404 are not required to practice the invention.

The turf sheet 404 has low heat absorption properties and efficiently dissipates heat that is absorbed so heat does not build up on the surface of the turf sheet and to make it hot or uncomfortable to walk on or play on.

In one embodiment, the turf sheet also includes a second impermeable layer 408 below the first permeable layer 406 that allows water to drain laterally. In another embodiment, the turf sheet 404 includes a combination with the first permeable layer 406. In such an embodiment, the first permeable layer 406 allows water to drain down directly into a second layer 410

Below the first layer 404 is a second layer 410 comprising a plural separate compartments 412, 414 (two of which are illustrated) including plural microbeads of pre-selected sizes and shapes. The plural separate compartments are filled to a pre-determined depth with the microbeads. In one embodiment, the plural separate components are completely filled with microbeads. In another embodiment, the plural separate components are not completely filed with microbeads.

In one embodiment, the plural microbeads comprise silicone, dacron, polystyrene, polypropylene, prolene, gortex, other plastic, rubber, composite materials and other natural and synthetic materials. In another embodiment, the second layer 410 comprises plural compartments including a fibrous material of varying thicknesses. In such an embodiment, the fibrous material includes a fiberglass, fiberous composite material, rubber, or other fibrous material that can be compressed and springs back. However, the present invention is not limited to this embodiment and other types of microbeads and other types of materials can also be used for the second layer 410.

As is known in the art, microbeads have been used for various devices bean-bag chairs, pillows, toys and other devices. When microbeads are used to fill an apparatus, the apparatus is light weight, yet firm, and retains the shape of the container.

A preferred range of microbead sizes is from approximately one millimeter (mm) to approximately five mm in diameter. However, the present invention is not limited such an embodiment and other sizes, both larger and smaller of microbeads can also be used to practice the invention.

In another embodiment, the microbeads can be replaced with pellets. The pellets silicone, dacron, polystyrene, polypropylene, prolene, gortex, other plastic, rubber, composite materials and other natural and synthetic materials. The pellets have sizes and surface characteristics different from those of microbeads and are produced with a different manufacturing process than those used for manufacturing microbeads.

A preferred range of pellets sizes is from approximately five millimeters (mm) to approximately seven mm in diameter. However, the present invention is not limited such an embodiment and other sizes, both larger and smaller of microbeads can also be used to practice the invention.

In one embodiment, the plural separate compartments include plural different sizes and shapes of microbeads. The different sizes, shapes and types of microbeads provide plural different types of resistance and firmness. How firm a surface is including microbeads is dependant on the size and shape of the microbeads and well as how the microbeads move in association with and make contact with other microbeads in a compartment. For example, circular-shaped microbeads have a different feel and resistance than oval-shaped or trapezoidal shaped microbeads.

Larger microbeads interact with each other in different ways than smaller microbeads. In another embodiment, the plural separate compartments include the same size and shape microbeads. In another embodiment, the plural separate compartments include the same size but different shape microbeads. In another embodiment, the plural separate compartments include the same shape but different size microbeads. However, the present invention is not limited to such embodiments and other embodiments and other combinations thereof can be used to practice the invention.

The plural separate compartments 412, 414 may each be filled with microbeads of a same size and shape or varying sizes and varying shapes or varying shapes and a same size or varying sizes and a same shape. An individual compartment 412 or 414 may also be filled with a mixture of microbeads of varying sizes, shapes and depths.

FIG. 9 illustrates a first compartment 412 including smaller microbeads. Such small microbeads may have a resistance like that of a natural sand or sandy material. FIG. 9 also illustrates a second compartment 414 including larger microbeads. Such larger microbeads have a different, greater resistance like that of a natural dirt or dirt like material.

In one embodiment, the plural compartments 412, 414 in the second layer 410 are filled with pre-determined depths to vary the resistance, feel and contour of the artificial surface 402.

For example, the first compartment 412 with the small microbeads may be filled to an exemplary depth of one inch to provide a sandy material like resistance while the second compartment 414 may be filled to an exemplary depth of four inches to provide a greater resistance dirt like material. However, the present invention is not limited to these embodiments, and other depths and other combinations can also be used to practice the invention.

In one embodiment the plural compartments are separate compartments separated by formal dividers. In another embodiment, the plural compartments include microbeads of pre-determined selected sizes and shapes contained within individual containing materials such as a mesh material or a bag-like membrane material to contain the microbeads. In such an embodiment, the mircobeads can be handled easier, changed easier and transported easier.

In one embodiment the separate compartments are plural individual and separate compartments that are placed in adjacent and in direct contact with each other. In such an embodiment, various types and depths of microbeads can be selected in virtually in combination to form a desired artificial surface. However, the present invention is not limited to this embodiment and other embodiments can be used to practice the invention.

In one embodiment, artificial surface 402 further includes a third layer 416. In one embodiment, the third layer 416 is permeable to water and allows water to drain directly onto the underlying surface to which the artificial surface 402 has been placed upon. In another embodiment, the third layer 416 is impermeable to water and allows water to be drained laterally off the artificial surface 402. In one embodiment, the third layer 416 comprises a polypropylene plastic, or other plastic. The invention can be practiced with or without all the layers described and illustrated in FIG. 9, or various combinations and other orderings thereof of the layers.

The artificial surface 402 is locally deformable. A user can shape and reshape a desired local deformed configuration in artificial surface 402 by re-adjusting the microbeads into a desired local depression configuration or a desired mound configuration. The desired local depression or mound configuration maintains its desired size and shape as a result of the characteristics of the microbeads (e.g., for a putting green, pitcher's mound, etc.).

Figure 10:
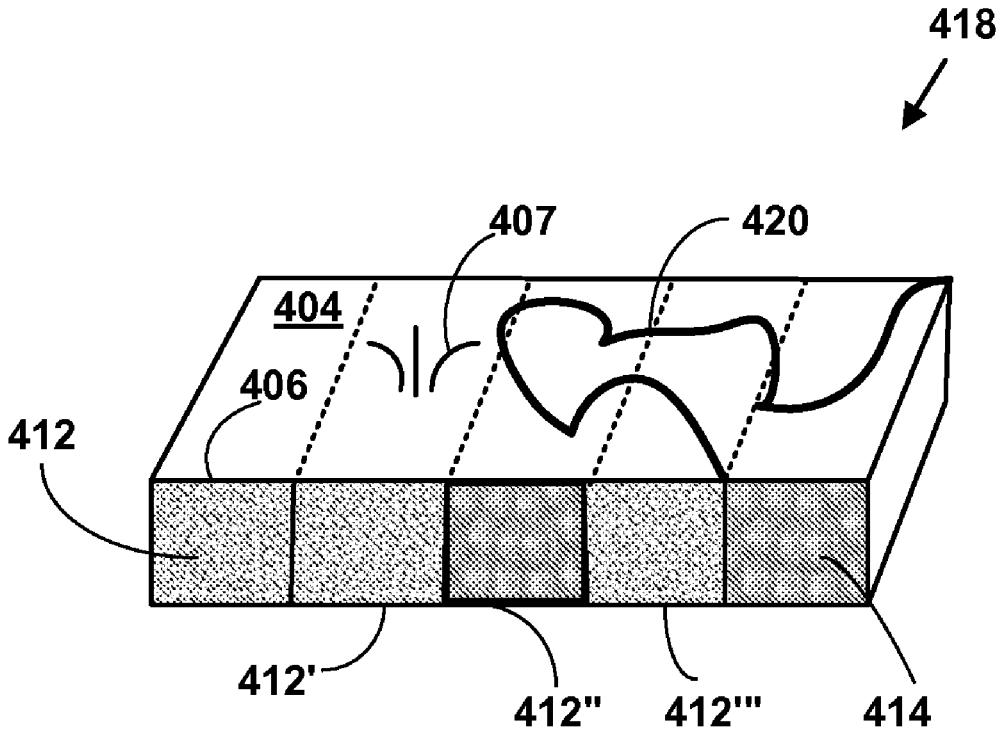
FIG. 10 is a block diagram illustrating a perspective view of a first artificial surface.

FIG. 10 is a block diagram illustrating a perspective view 418 of artificial surface 402 with first compartment 412 and second compartment 414 with different sized microbeads. Such an embodiment may be used for a golf course and other landscaping features. In this figure, the first compartment 412 and the second compartment 414 are illustrated as irregular shapes with an irregular contour 420. Have, the present invention is not limited to such compartment shapes and other shapes and other combinations can also be used to practice the invention.

In FIG. 10, the first compartment 412 is illustrated divided into four separate compartments 412, 412', 412" and 412'" by plural vertical dividers. In FIG. 10, compartments 412, 412" and 412" illustrate smaller sized microbeads and compartments 412' and 414 illustrate larger sized microbeads. Such mixtures of microbeads provide differing resistance and firmness to selected portions of the artificial surface 402.

Figure 11:
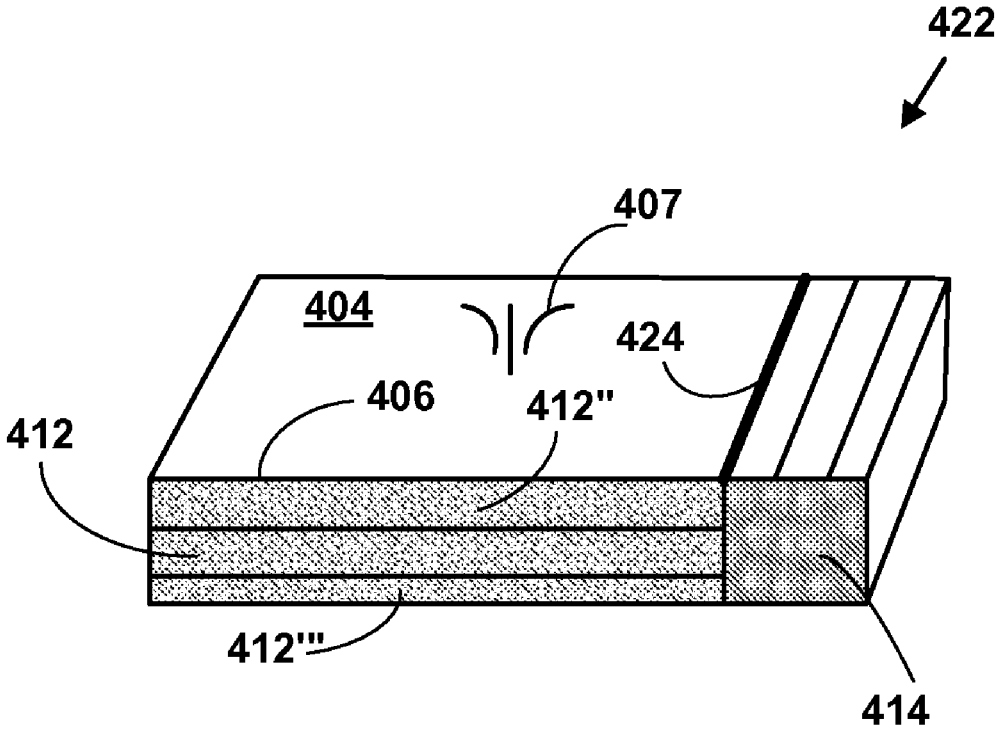
FIG. 11 is a block diagram illustrating a perspective view of a second artificial surface.

FIG. 11 is a block diagram illustrating a perspective view 422 of artificial surface with first compartment 412 and second compartment 414 with different sized microbeads. In this figure, the first compartment 412 and the second compartment 414 are illustrated as regular shapes with a regular contour 424. Such an embodiment may be used for a landscape feature such as a retaining wall, a pitching mound, etc.

In FIG. 11, the first compartment 412 is illustrated divided into five separate compartments 412, 412', 412" and 412'" separated by plural horizontal dividers. Second compartment 412 includes a vertical divider.

The plural dividers include horizontal, vertical, angular or other combinations thereof. The plural dividers can be equally spaced or unequally spaced or in various combinations and different orderings thereof. In such an exemplary embodiment, the individual compartments are filled with microbeads of a pre-determined size, shape and depth. The size shape and depth of the microbeads can be the same or different in each individual compartment to provide different levels of resistance. Have, the present invention is not limited to such dividers and other dividers and other combinations can also be used to practice the invention.

In one embodiment, a pre-determined compound is applied to the microbeads which introduces an electrical charge to the microbeads. The electrical charge changes a resistance and firmness provided to the artificial surface by the microbeads. Different sets of microbeads can have different chemical compounds applied to them with different electrical charges. The surfaces of the microbeads with charges interact in a distinctly different way when the pre-determined compound is applied.

For example, a carboxyl compound can be applied to the microbeads resulting in a negative surface charge. An oligonucleotide compound can be applied to the microbeads resulting in a significant negative surface charge. A mesocarbon compound can be applied to the microbeads resulting in a negative surface charge. A calcium compound (e.g., $Ca^{+2}$ compound) can be applied to the microbeads resulting in a positive surface charge. Compounds which result in a negative surface charge and compounds which result in a positive surface charge can be applied to different selected ones of the microbeads or different parts of the same microbeads.

Compounds which result in a different negative surface charge voltages and compounds which result in different positive surface charge voltages can be applied to the microbeads.

The positive and negative surface charged microbeads can be mixed in individual compartments (e.g., 412) with microbeads for which a compound has not been applied, or with microbeads for which different chemical compounds have been applied, or placed in separate but adjoining compartments (e.g., 412, 414) with various combinations of microbeads without and with having a same or a different chemical compound applied to produce a desired interaction and provide additional different resistance and firmness characteristics for the artificial surface 402. The compound selected is in part determined by chemical composition of the microbead (e.g., silicone, dacron, polystyrene, polypropylene, prolene, gortex, etc.). However, the present invention is not limited to these exemplary compounds or mixtures or alignments and other compounds that produce other positive and negative surface charges, or a combination thereof (e.g., some positive surfaces charges, some negative surface charges, etc.) and other mixtures or alignments can be used to practice the invention.

In another embodiment, the microbeads are produced directly with a desired surface charge (e.g., mesocarbon microbeads, etc.) In such an embodiment, the microbeads do not have the chemical compound applied.

The apparatus described herein provides a layered, artificial surface including plural components filled with microbeads of pre-selected sizes, shapes and depths. The microbeads of the pre-selected sizes and shapes and depths provide plural different types of resistance and firmness for the artificial surface. Pre-determined chemical compounds can also be applied to the microbeads to change a surface charge on the microbeads, or produced with a desired surface charge to provide different interactions and thus different types of resistance and firmness for the artificial surface. The artificial surface does not require the application of a vacuum to maintain a shape or resistance.

It should be understood that the components described herein are not related or limited to any particular type of components unless indicated otherwise. Various types of general purpose or specialized components may be used with or perform operations in accordance with the teachings described herein.

In view of the wide variety of embodiments to which the principles of the present invention can be applied, it should be understood that the illustrated embodiments are exemplary only, and should not be taken as limiting the scope of the present invention. For example, more or fewer elements may be used in the block diagrams. The elements may be used in other orders than those described (e.g., reverse order, etc.).

The claims should not be read as limited to any particular size, dimension or component unless stated to that effect. In addition, use of the term "means" in any claim is intended to invoke 35 U.S.C. §112, paragraph 6, and any claim without the word "means" is not so intended.

Therefore, all embodiments that come within the scope and spirit of the following claims and equivalents thereto are claimed as the invention.

We claim:

1. An artificial surface, comprising in combination:

first layer including a top surface comprising an artificial turf sheet and a permeable layer below the artificial turf sheet that absorbs and drains water from the artificial surface; and a second layer in contact the first layer including a plurality of separate compartments including a plurality of microbeads of pre-selected sizes and shapes, wherein an initial contour of the artificial surface is formed by an interaction of the artificial turf sheet and mircobeads in the plurality of separate compartments of the pre-selected sizes and shapes filled to pre-selected depths, wherein interactions of the surfaces of microbeads of the pre-selected sizes and shapes and depths provide a plurality of different types of resistance and firmness for the artificial surface, and wherein the artificial surface does not require the application of a vacuum to maintain a shape or resistance; and the plurality of microbeads including a pre-determined compound applied to surfaces of the plurality of microbeads to produce an electrical charge on the surfaces thereof, wherein the electrical charge provides different resistance and firmness properties of the artificial surface compared to an artificial surface comprising a plurality of microbeads without the pre-determined compound applied.

2. The artificial surface of claim 1 wherein artificial turf sheet includes polypropylene artificial grass with plurality of groups of fibers that have been tufted on a porous backing, wherein the plurality of groups of fibers are water resistant and the porous backing insures the proper water drainage.

3. The artificial surface of claim 1 wherein the artificial turf sheet includes a plurality of polyethylene synthetic fibers that are protected against Ultra Violet (UV) radiation.

4. The artificial surface of claim 1 the artificial turf sheet has low heat absorption properties and efficiently dissipates heat that is absorbed so heat does not build up on the surface of the artificial turf sheet.

5. The artificial surface of claim 1 wherein the artificial turf sheet further comprises an impermeable layer below the first permeable layer that allows water to drain laterally from the artificial surface.

6. The artificial surface of claim 5 further comprising a third layer below the second layer, wherein the third layer is permeable to water and allows water to drain directly onto the underlying surface to which the artificial surface has been placed upon.

7. The artificial surface of claim 1 wherein the microbeads include silicone, polystyrene, polypropylene, other plastic, rubber or composite material microbeads.

8. The artificial surface of claim 1 wherein the pre-selected shapes of the microbeads include circular-shaped, or oval-shaped or trapezoidal shaped microbeads.

9. The artificial surface of claim 1 wherein the pre-selected sizes of the microbeads include mircobeads approximately one millimeter (mm) to approximately five mm in diameter.

10. The artificial surface of claim 1 wherein the plurality of microbeads in the plurality of separate compartments are contained in a mesh material or a bag membrane material to contain the microbeads.

11. The artificial surface of claim 1 wherein the artificial surface is locally deformable, wherein a user can shape and reshape a desired local deformed configuration in artificial surface by re-adjusting the microbeads into a desired local depression configuration or a local mound configuration wherein the desired local depression configuration or desired local mound configuration maintains its desired size and shape as a result of the characteristics of the microbeads.

12. The artificial surface of claim 1 wherein the plurality of separate compartments may be filled with microbeads of a same size and shape or varying sizes and varying shapes or varying shapes and a same size or varying sizes and a same shape.

13. The artificial surface of claim 1 wherein an individual compartment in the plurality of separate compartment may also be filled with a mixture of microbeads of varying sizes, shapes and depths.

14. The artificial surface of claim 1 wherein microbeads with the pre-determined compound applied are mixed with other microbeads for which the pre-determined compound has not been applied in an individual compartment.

15. The artificial surface of claim 1 wherein microbeads with the pre-determined compound applied are placed in individual compartments adjacent to other individual compartments with microbeads for which the pre-determined compound has not been applied.

16. The artificial surface of claim 1 wherein the pre-determined compound includes a plurality of different pre-determined compounds wherein individual compounds from the plurality of pre-determined compounds introduce different electrical charges to surfaces of the microbeads.

17. The artificial surface of claim 1 further comprising microbeads produced directly including the pre-determined compound as a surface layer with a desired surface charge during manufacture thereof of the microbeads.

18. An artificial surface, comprising in combination:

means for providing a cover layer with a top surface and permeable layer below the top surface that absorbs and drains water from the artificial surface; and means for providing a configurable layer below the cover layer including a plurality of separate compartments including a plurality of microbeads of pre-selected sizes and shapes, wherein an initial contour of the artificial surface is formed by an interaction of the artificial turf sheet and mirco-beads in the plurality of separate compartments of the pre-selected sizes and shapes filled to a pre-selected depths, wherein interactions of the surfaces of microbeads of the pre-selected sizes and shapes and depths provide a plurality of different types of resistance and firmness for the artificial surface, and wherein the artificial surface does not require the application of a vacuum to maintain a shape or resistance; and means for applying a pre-determined compound to surfaces of the plurality of microbeads to produce an electrical charge on the surfaces thereof, wherein the electrical charge provides different resistance and firmness properties of the artificial surface compared to an artificial surface comprising a plurality of microbeads without the pre-determined compound applied.

* * * * *